US007398957B2

(12) United States Patent
Burns

(10) Patent No.: US 7,398,957 B2
(45) Date of Patent: Jul. 15, 2008

(54) WINCH HAVING INTEGRATED INVERTER FOR PROVIDING AC POWER

(75) Inventor: David Burns, West Linn, OR (US)

(73) Assignee: Warn Industries, Inc., Milwaukie, OR (US)

( * ) Notice: Subject to any disclaimer, the term of this patent is extended or adjusted under 35 U.S.C. 154(b) by 0 days.

(21) Appl. No.: 11/554,112

(22) Filed: Oct. 30, 2006

(65) Prior Publication Data

US 2008/0099738 A1 May 1, 2008

(51) Int. Cl.
*B66D 1/00* (2006.01)

(52) U.S. Cl. ..... 254/323; 254/362

(58) Field of Classification Search ..... 254/323, 254/328, 362, 371
See application file for complete search history.

(56) References Cited

U.S. PATENT DOCUMENTS 3,844,535 A * 10/1974 Dorough, Jr. ..... 254/103
3,938,122 A * 2/1976 Mangus ..... 340/431
5,522,582 A * 6/1996 Dilks ..... 254/323
5,692,735 A * 12/1997 Aho et al. ..... 254/323
6,273,225 B1 * 8/2001 Park ..... 191/12.2 R
6,386,514 B1 * 5/2002 Ray ..... 254/323
6,758,314 B2 * 7/2004 Woodruff ..... 191/12.2 R
6,798,343 B2 * 9/2004 Carrier et al. ..... 340/539.13
6,995,682 B1 * 2/2006 Chen et al. ..... 340/825.72
7,119,454 B1 10/2006 Chiao

OTHER PUBLICATIONS

Inverter. (2003). In The American Heritage® Dictionary of the English Language. Retrieved Oct. 16, 2007, from http://www.credoreference.com/entry/4099686.*
Inverter. (1992). In Academic Press Dictionary of Science and Technology. Retrieved Oct. 16, 2007, from http://www.credoreference.com/entry/3119057.*

* cited by examiner

*Primary Examiner*—Evan H Langdon
(74) *Attorney, Agent, or Firm*—Harness, Dickey & Pierce, P.L.C.

(57) ABSTRACT

A winch mechanism is provided with an integrated inverter for providing AC electric power from a DC electric power source. The winch mechanism is also provided with a plug receptacle to allow standard AC electric devices to be plugged into the winch mechanism so that the appliance can be utilized remotely from other AC electric power sources. An additional jump start storage device can be provided on the winch for providing back-up jump start storage.

17 Claims, 2 Drawing Sheets

FIG 1
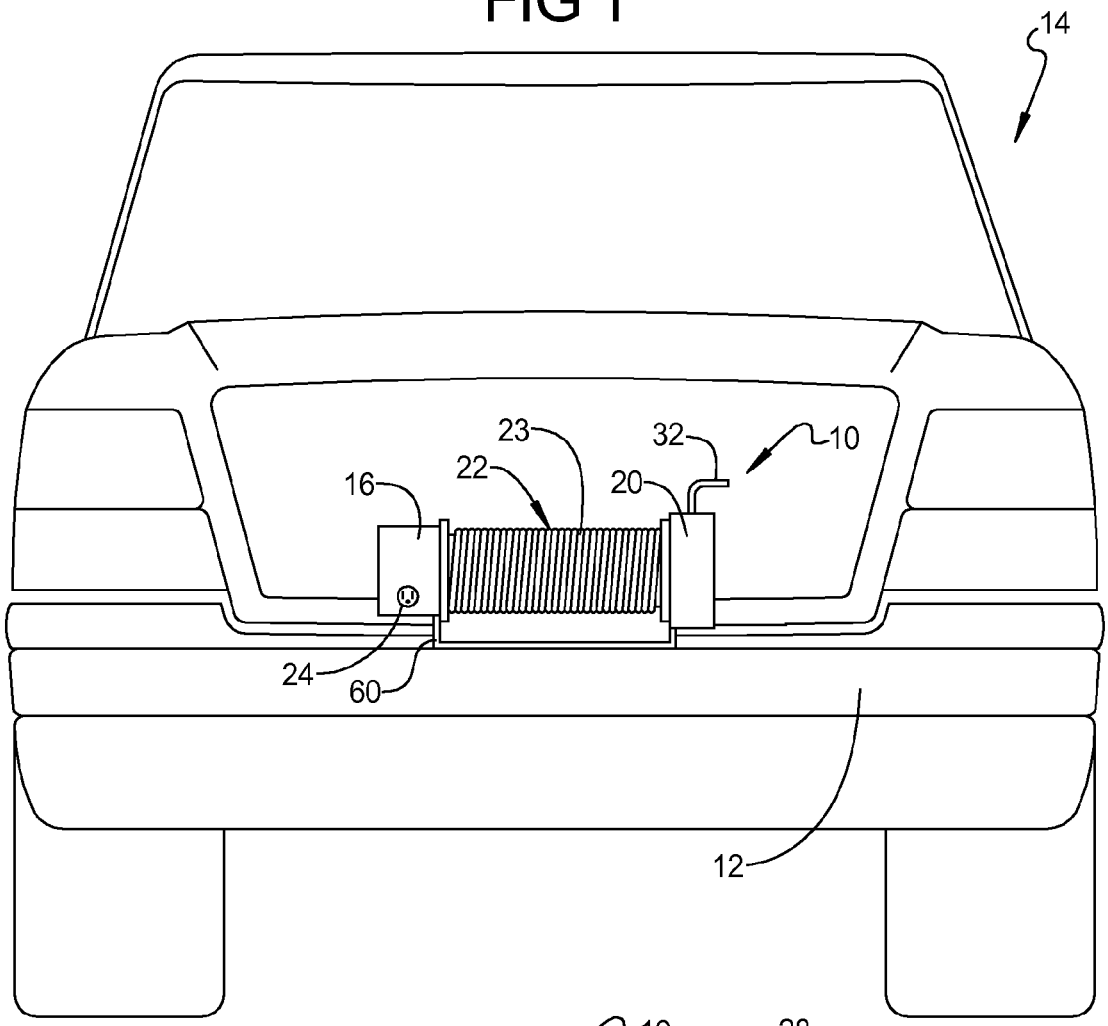
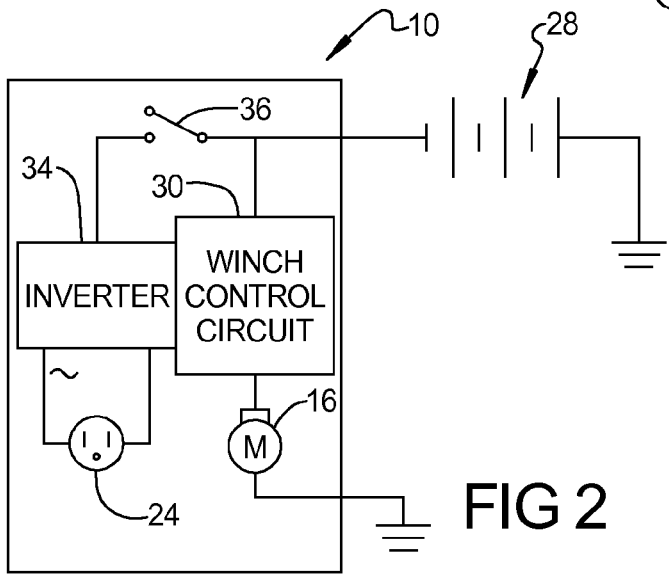
FIG 2

WINCH HAVING INTEGRATED INVERTER FOR PROVIDING AC POWER

FIELD OF THE INVENTION

The present invention relates to a winch mechanism having an integrated inverter for providing AC electric power via the winch.

BACKGROUND AND SUMMARY OF THE INVENTION

The statements in this section merely provide background information related to the present disclosure and may not constitute prior art.

Winches have been commonly mounted to a support bracket at the front bumper location of an automobile, and have been used to perform a variety of tasks, such as dragging a large object while the vehicle is stationary, or moving the vehicle itself by attaching the free end of the winch cable to a stationary object and reeling in the cable to pull the vehicle toward that object. These typical winches include a cable winding drum supported on each end and including an electric or hydraulic motor in combination with a speed reducing gear transmission for transmitting torque to the cable winding drum. The use of winches with off-road and utility vehicles has greatly enhanced the function of the vehicles. However, it is still desirable to further enhance the vehicle functionality, as well as the functionality of the winch.

The present invention provides a winch mechanism with an integrated inverter for providing AC electric power from a vehicle battery or other power source so as to enhance the functionality of the winch as it is used on a vehicle, or as is used in other industrial applications. The winch mechanism is provided with a plug receptacle on the housing thereof to allow AC powered electric devices to be plugged into the winch to allow operation of the AC electronic devices remotely from other AC electric power sources. The integrated inverter of the present invention takes advantage of the existing high amperage wiring of the winch and, therefore, has limited additional cost.

In addition, additional jump start storage can be provided via a secondary battery or capacitance device.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIG. 1 illustrates a winch mechanism having an integrated inverter according to the principles of the present invention;

FIG. 2 is a schematic diagram of the winch mechanism having an integrated inverter according to the principles of the present invention

DETAILED DESCRIPTION OF THE PREFERRED EMBODIMENTS

Figure 3:
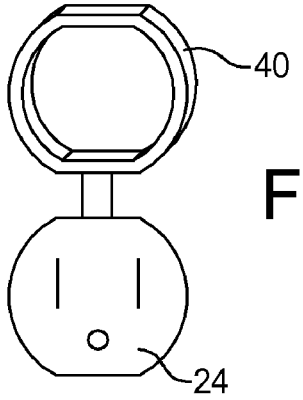
FIG. 3 is an illustration of a plug receptacle including a removable cover portion.

The following description is merely exemplary in nature and is not intended to limit the present disclosure, application, or uses. It should be understood that throughout the drawings, corresponding reference numerals indicate like or corresponding parts and features.

With reference to FIG. 1, the winch mechanism 10 having an integrated inverter is shown mounted to a front bumper 12 of a vehicle 14. The winch mechanism 10 includes an electric motor 16 which has an output shaft engaged with a switchable gear case 20 that is selectively operable to provide driving torque to the winch drum 22. A cable 23 is wound on the drum 22. The winch mechanism 10 includes a housing having a plug receptacle 24 mounted therein.

With reference to FIG. 2, the winch mechanism 10 is connected to a battery 28 or other DC electric power source. The winch mechanism 10 includes a winch control circuit 30 connected to the battery 28 that is capable of controlling operation of the winch mechanism 10 as is known in the art. The winch control circuit 30 can include dedicated solid state controls, etc. for controlling operation of the drum 22 in a winding and un-winding direction. The winch mechanism 10 also includes an integrated inverter 34 that is also engageable with the battery 28 by switch mechanism 36 for providing AC electric current to the plug receptacle 24 mounted to the winch mechanism 10.

Figure 4:
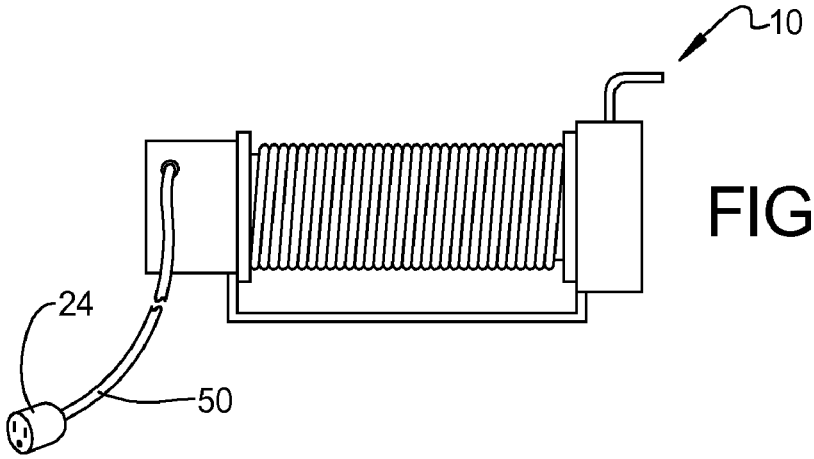
FIG. 4 illustrates a winch mechanism including a retractable extension cord according to the principles of the present invention.
Figure 5:
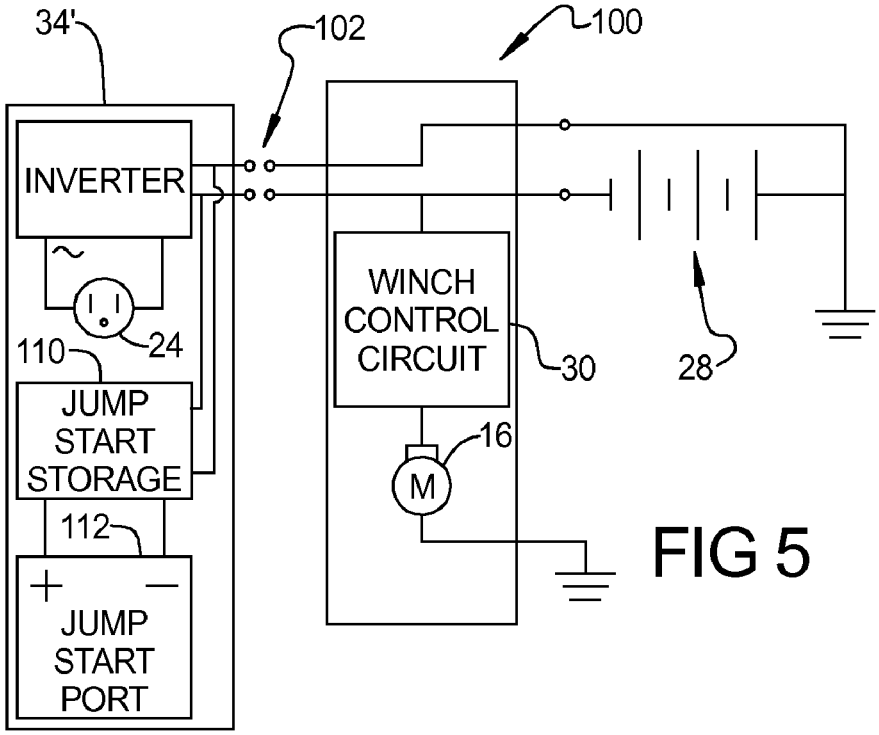
FIG. 5 is a schematic diagram of the winch mechanism having a removable inverter module and a jump start storage according to the principles of the present invention.

With the integrated inverter 34 and plug receptacle 24, the winch mechanism 10 is capable of converting the DC electric power from the battery 28 (or other DC power source) to AC electric power that can be utilized to operate AC powered electronic devices remotely from other AC power sources. It should be understood that the plug receptacle 24 can be mounted to the winch mechanism 10 in various accessible locations and can optionally be provided with a removable covering 40 as illustrated in FIG. 3 in order to protect the plug receptacle from water, dirt and other environmental elements. Furthermore, the plug receptacle 24 can also be provided on a retractable extension cord 50 that retracts into the housing of the winch mechanism as illustrated in FIG. 4. In addition, as illustrated in FIG. 5, the inverter 34' can be provided as a separate detachable module that can be plugged into the housing of the winch mechanism 100 when needed and electrically connected to the battery 28 by corresponding electrical connectors 102 disposed on the winch housing. The inverter module 34' would also include a plug receptacle 24 mounted thereon. In either embodiment (FIG. 2 or FIG. 5), the inverter 34, 34' of the present invention takes advantage of the existing high amperage wiring of the winch and, therefore, has limited additional cost.

An additional jump start storage device 110 can also be implemented with the inverter in the form of secondary battery or a capacitance device, as shown in FIG. 5. The jump start storage device 110 can further include additional terminals 112 that serve as a jump start port that can be used to jump start the vehicle 14 or other vehicles. The jump start storage 110 can be utilized with the separate detachable inverter module 34' or can be implemented in the dedicated system of FIG. 2.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a winch including an electric motor, a drum mechanism and a cable, said electric motor adapted to be connected to a source of DC electric power, said drum mechanism operable to be rotatably driven by said electric motor, and said cable adapted to be wound onto and off from said drum mechanism;

an inverter adapted to be connected to said source of DC electric power, said inverter being adapted to convert a direct current into an alternating current; and a plug receptacle connected to said inverter, wherein said inverter is integrated with said winch, and the inverter is connected to a high amperage wiring of the winch.

2. The apparatus according to claim 1, further comprising a removable cover on said plug receptacle.

3. The apparatus according to claim 1, wherein said plug receptacle is disposed on a retractable cord.

4. The apparatus according to claim 1, wherein said inverter is removably connected to said source of DC electric power.

5. The apparatus according to claim 1, further comprising a jump start storage device connected to said inverter.

6. The apparatus according to claim 5, wherein said jump start storage device includes a pair of terminals.

7. The apparatus according to claim 5, wherein said jump start storage device includes a battery.

8. The apparatus according to claim 5, wherein said jump start storage device includes a capacitance device.

9. A winch comprising:

a support structure;

an electric motor mounted to said support structure;

a drum mechanism supported by said support structure and operable to be rotatably driven by said electric motor;

a cable adapted to be wound onto and off from said drum mechanism; and a high amperage wiring facilitating electrical communication between a source of DC electric power and said electric motor, wherein an inverter is supported by said support structure and adapted to be connected to said source of DC electric power via said high amperage wiring, whereby said inverter is integrated with said winch; and further wherein said inverter is adapted to convert a direct current into an alternating current.

10. The apparatus according to claim 9, further comprising a plug receptacle connected to said inverter.

11. The apparatus according to claim 10, wherein said plug receptacle is mounted to said support structure.

12. The apparatus according to claim 10, wherein said plug receptacle is disposed on a retractable extension cord which is retractable into said support structure.

13. The apparatus according to claim 9, wherein said inverter is removably connected to said support structure.

14. The apparatus according to claim 9, further comprising a jump start storage device connected to said inverter.

15. The apparatus according to claim 14, wherein said jump start storage device includes a pair of terminals.

16. The apparatus according to claim 14, wherein said jump start storage device includes a battery.

17. The apparatus according to claim 14, wherein said jump start storage device includes a capacitance device.

* * * * *